US010724304B2

(12) United States Patent
Bomidi et al.

(10) Patent No.: US 10,724,304 B2
(45) Date of Patent: Jul. 28, 2020

(54) CUTTING ELEMENT ASSEMBLIES AND DOWNHOLE TOOLS COMPRISING ROTATABLE AND REMOVABLE CUTTING ELEMENTS AND RELATED METHODS

(71) Applicant: Baker Hughes, a GE company, LLC, Houston, TX (US)

(72) Inventors: John Abhishek Raj Bomidi, Spring, TX (US); Jon David Schroder, The Woodlands, TX (US); Kegan L. Lovelace, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 16/189,037

(22) Filed: Nov. 13, 2018

(65) Prior Publication Data

US 2019/0145182 A1 May 16, 2019

Related U.S. Application Data

(60) Provisional application No. 62/585,252, filed on Nov. 13, 2017.

(51) Int. Cl.
*E21B 10/573* (2006.01)
*E21B 7/04* (2006.01)
(Continued)

(52) U.S. Cl.
CPC ..... *E21B 10/573* (2013.01); *E21B 7/046* (2013.01); *E21B 10/43* (2013.01); *E21B 10/55* (2013.01);
(Continued)

(58) Field of Classification Search
CPC ..... E21B 10/43; E21B 10/55; E21B 10/573; E21B 10/602; E21B 2010/425; E21B 2010/545; E21B 2010/564; E21B 7/046
See application file for complete search history.

(56) References Cited

U.S. PATENT DOCUMENTS 4,877,096 A * 10/1989 Tibbitts ..... E21B 10/573 175/432
5,678,645 A * 10/1997 Tibbitts ..... E21B 10/5673 175/426
(Continued)

OTHER PUBLICATIONS

International Written Opinion for International Application No. PCT/US2018/060694 dated Mar. 8, 2019, 7 pages.
(Continued)

*Primary Examiner* — James G Sayre
(74) *Attorney, Agent, or Firm* — TraskBritt

(57) ABSTRACT

A cutting element assembly includes a sleeve having a cutter-receiving aperture extending through the sleeve, a cutting element, and a rotation restriction element. The cutting element may include a first plurality of retention elements extending substantially radially from an outer surface of the cutting element and engaging the sleeve to retain the cutting element within the sleeve. The rotation restriction element may be coupled to the cutting element and may include a second plurality of retention elements extending axially from a bottom surface of the rotation restriction element and engaging the sleeve to restrict rotation of the cutting element within the sleeve.

18 Claims, 7 Drawing Sheets

(51) Int. Cl.

| | |
|---|---|
| ***E21B 10/55*** | (2006.01) |
| ***E21B 10/60*** | (2006.01) |
| ***E21B 10/43*** | (2006.01) |
| ***E21B 10/56*** | (2006.01) |
| ***E21B 10/42*** | (2006.01) |
| ***E21B 10/54*** | (2006.01) |

(52) U.S. Cl.
CPC ..... *E21B 10/602* (2013.01); *E21B 2010/425* (2013.01); *E21B 2010/545* (2013.01); *E21B 2010/564* (2013.01)

(56) References Cited

U.S. PATENT DOCUMENTS

| | | | | |
|---|---|---|---|---|
| 8,011,456 | B2 | 9/2011 | Sherwood, Jr. | |
| 9,803,427 | B1 | 10/2017 | Cooley et al. | |
| 2010/0212964 | A1* | 8/2010 | Beuershausen | E21B 10/62 175/57 |
| 2010/0314176 | A1* | 12/2010 | Zhang | E21B 10/573 175/383 |
| 2012/0273281 | A1* | 11/2012 | Burhan | E21B 10/54 175/431 |
| 2013/0112480 | A1* | 5/2013 | Newman | E21B 10/62 175/57 |
| 2014/0216827 | A1 | 8/2014 | Zhang et al. | |
| 2018/0355672 | A1* | 12/2018 | De Maindreville | E21B 10/573 |

OTHER PUBLICATIONS

International Search Report for International Application No. PCT/US2018/060694 dated Mar. 8, 2019, 3 pages.

* cited by examiner

CUTTING ELEMENT ASSEMBLIES AND DOWNHOLE TOOLS COMPRISING ROTATABLE AND REMOVABLE CUTTING ELEMENTS AND RELATED METHODS

CROSS-REFERENCE TO RELATED APPLICATION

This application claims the benefit under 35 U.S.C. § 119(e) of U.S. Provisional Patent Application Ser. No. 62/585,252, filed Nov. 13, 2017, the disclosure of which is hereby incorporated herein in its entirety by this reference.

FIELD

Embodiments of the present disclosure relate generally to removable cutting elements and earth-boring tools having such cutting elements, as well as related methods of forming downhole tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

In addition to drill strings, other tool strings may be disposed in an existing well bore for, among other operations, completing, testing, stimulating, producing, and remediating hydrocarbon-bearing formations.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on body a drill bit by brazing. The drill bit body is formed with recesses therein, commonly termed "pockets," for receiving a substantial portion of each cutting element in a manner which presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting element via a torch to raise the temperature to a point high enough to braze the cutting elements to the bit body in a fixed position but not so high as to damage the PCD layer.

Unfortunately, securing a PDC cutting element to a drill bit restricts the useful life of such cutting element, because the cutting edge of the diamond table and the substrate wear down, creating a so-called "wear flat" and necessitating increased weight-on-bit to maintain a given rate of penetration of the drill bit into the formation due to the increased surface area presented. In addition, unless the cutting element is heated to remove it from the bit and then rotated to be re-brazed with an unworn portion of the cutting edge presented for engaging a formation, more than half of the cutting element is never used.

DETAILED DESCRIPTION

Figure 1:
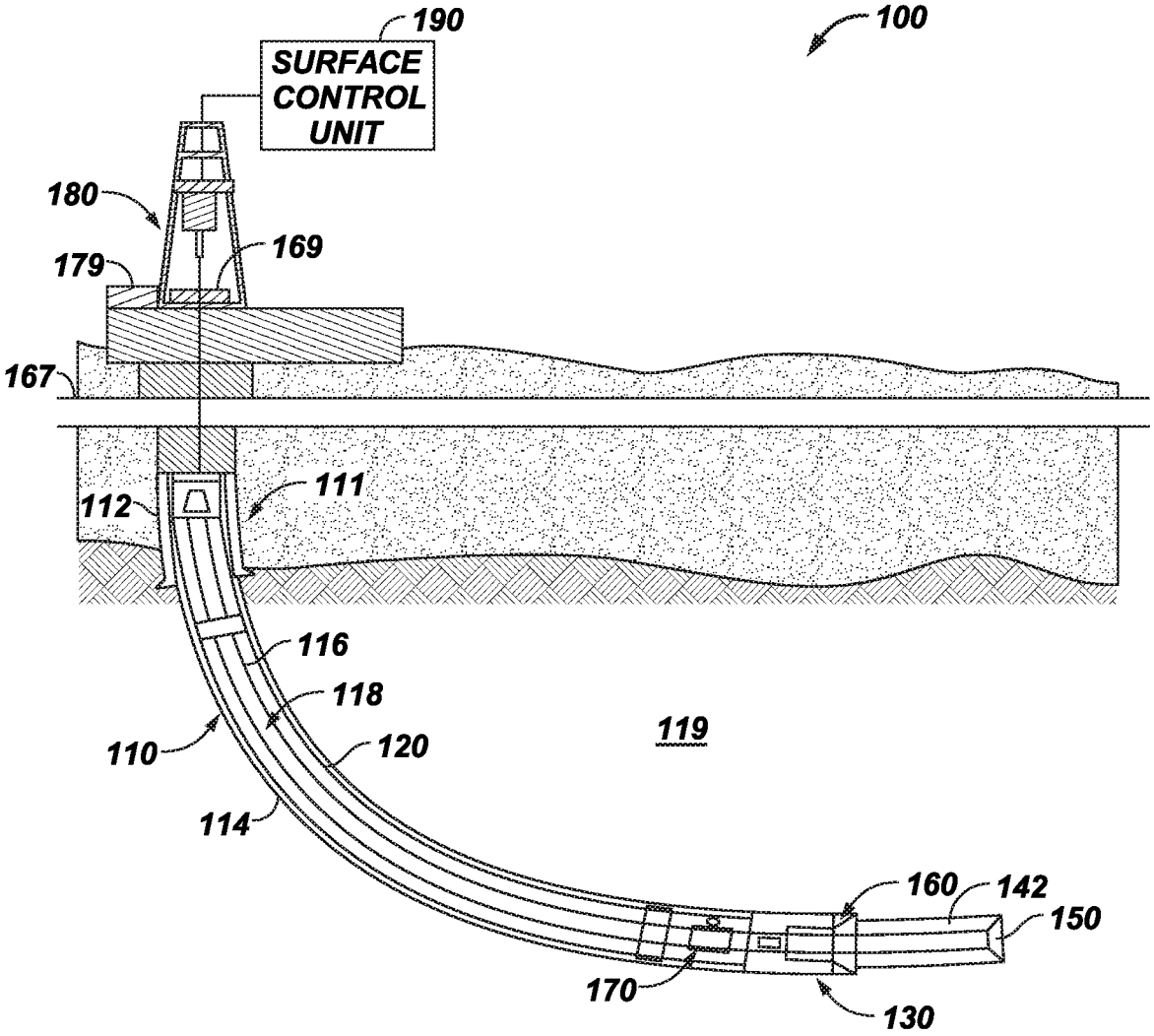
FIG. 1 is a simplified schematic diagram of an example of a drilling system using cutting element assemblies according to one or more embodiments of the present disclosure.

The illustrations presented herein are not actual views of any particular cutting assembly, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "below," "lower," "bottom," "above," "upper," "top," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $kg/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that may include an upper section 111 with a casing 112 installed therein and a lower section 114 that is being drilled with a drill string 118. The drill string 118 may include a tubular member 116 that carries a drilling assembly 130 at its bottom end. The tubular member 116 may be coiled tubing or may be formed by joining drill pipe sections. A drill bit 150 (also referred to as the "pilot bit") may be attached to the bottom end of the drilling assembly 130 for drilling a first, smaller diameter borehole 142 in the formation 119. A reamer 160 may be placed above or uphole of the drill bit 150 in the drill string to enlarge the borehole 142 to a second, larger diameter borehole 120. The terms wellbore and borehole are used herein as synonyms.

The drill string 118 may extend to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively form boreholes 142 and 120. The rig 180 may also include conventional devices, such as mechanisms to add additional sections to the tubular member 116 as the wellbore 110 is drilled. A surface control unit 190, which may be a computer-based unit, may be placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 may rotate. The pilot bit 150 drills the first, smaller diameter borehole 142, while simultaneously the reamer bit 160 enlarges the borehole 142 to a second, larger diameter 120. The earth's subsurface formation may contain rock strata made up of different rock structures that can vary from soft formations to very hard formations, and therefore the pilot bit 150 and/or the reamer bit 160 may be selected based on the formations expected to be encountered in a drilling operation.

Figure 2:
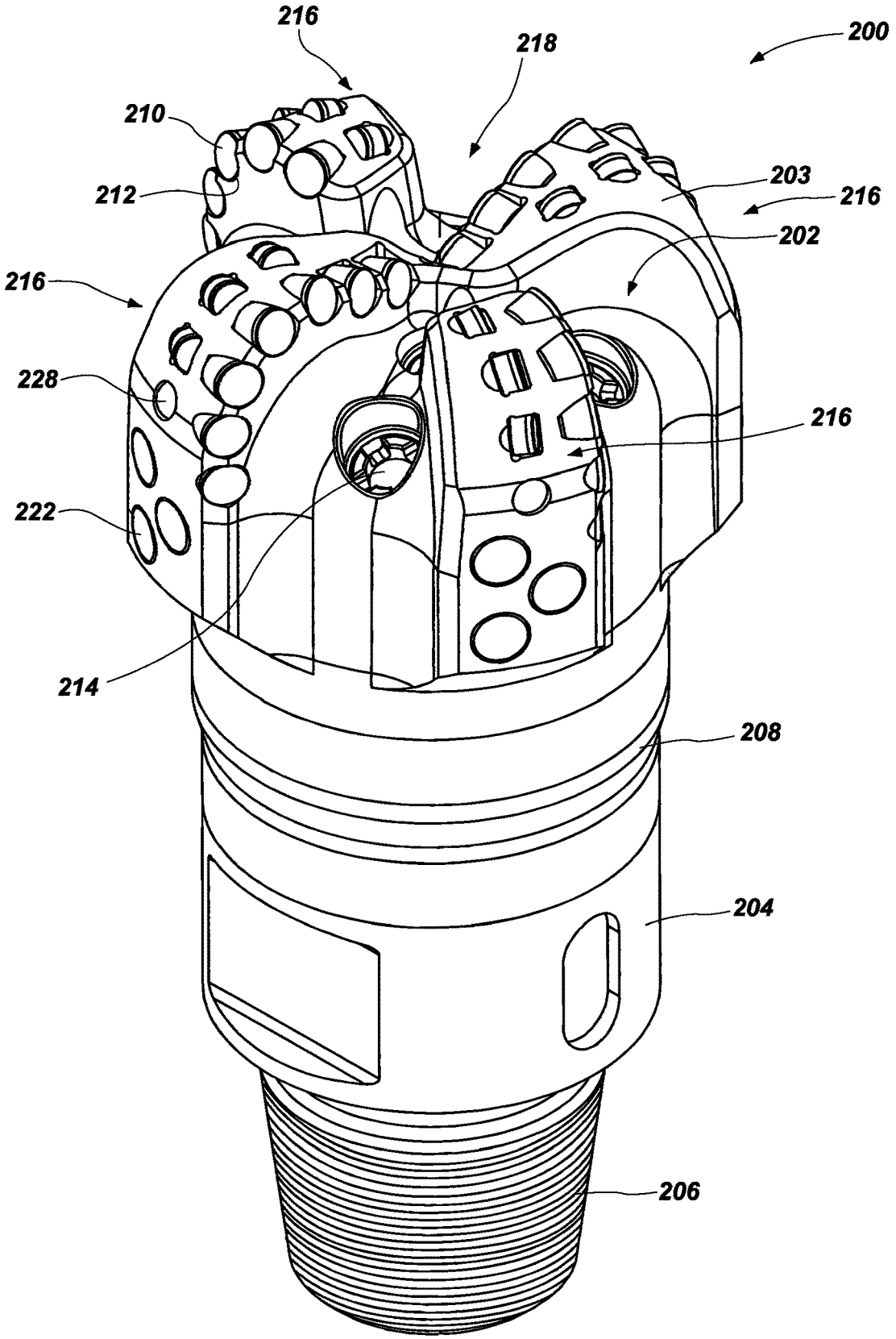
FIG. 2 is a simplified perspective view of a fixed-blade earth-boring rotary drill bit that may be used in conjunction with the drilling system of FIG. 1.

FIG. 2 is a perspective view of a fixed-cutter earth-boring rotary drill bit 200 that may be used in conjunction with the drilling system 100 of FIG. 1. For example, the drill bit 200 may be the pilot bit 150 shown in FIG. 1. The drill bit 200 includes a bit body 202 that may be secured to a shank 204 having a threaded connection portion 206 (e.g., an American Petroleum Institute (API) threaded connection portion) for attaching the drill bit 200 to a drill string (e.g., drill string 118, shown in FIG. 1). In some embodiments, the bit body 202 may be secured to the shank 204 using an extension 208. In other embodiments, the bit body 202 may be secured directly to the shank 204.

The bit body 202 may include internal fluid passageways that extend between the face 203 of the bit body 202 and a longitudinal bore, extending through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting element assemblies 210 may be mounted on the face 203 of the bit body 202 in cutting element pockets 212 that are located along each of the blades 216. The cutting element assemblies 210 may include PDC cutting elements, or may include other cutting elements. For example, some or all of the cutting element assemblies 210 may include rotatable cutting elements, as described below and shown in FIGS. 3A-5C.

Figure 3:
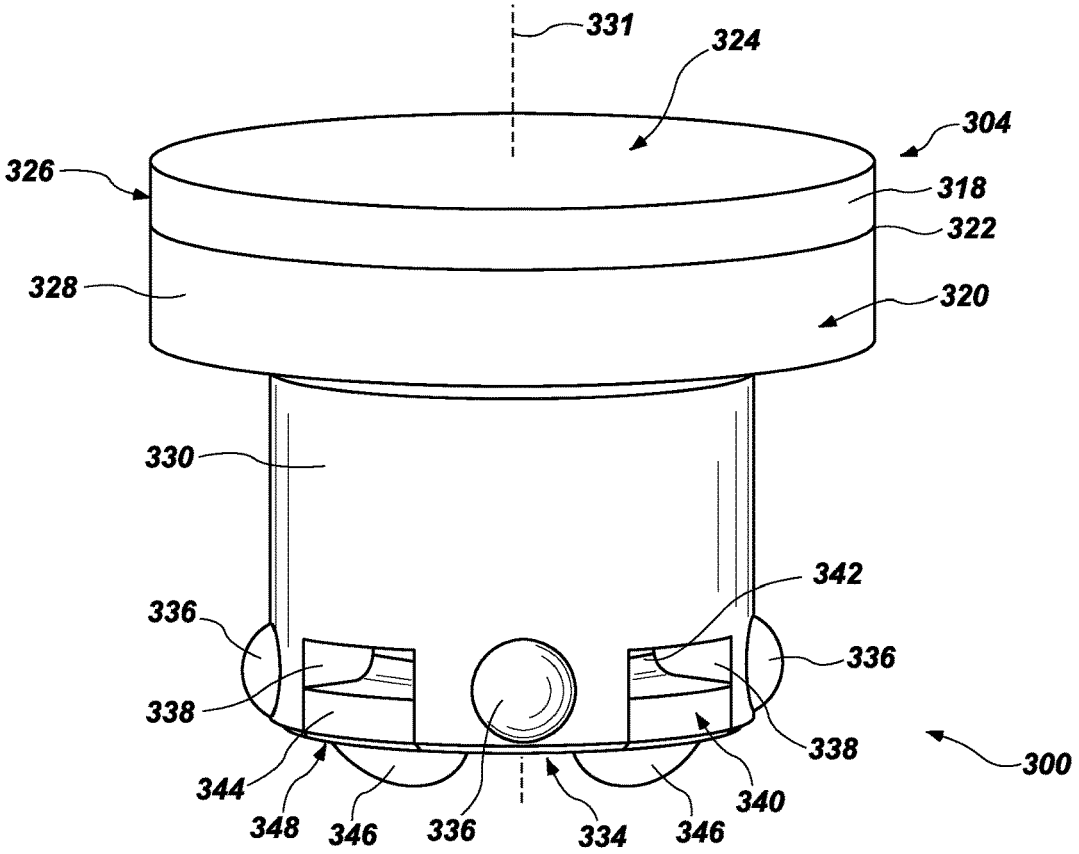
FIG. 3 is a perspective view of a cutting element of a cutting element assembly according to one or more embodiments of the present disclosure.

FIG. 3 is a perspective view of a rotatable and removable cutting element 304 (referred to herein as "cutting element") of a cutting element assembly 300 (shown between FIGS. 3 and 4) that can be mounted to a body portion, such as a blade, of an earth-boring tool. As is discussed in greater detail below, the cutting element 304 may be removable from and rotatable within a sleeve secured to the body portion, without utilizing heat. As a result, the cutting element 304 herein may be relatively easily removed and replaced, such as when the cutting element is worn or damaged. The blade may be, for example, one of the blades 216 shown in FIG. 2. The cutting element assembly 300 may be one of the cutting element assemblies 210 shown in FIG. 2. Furthermore, as described briefly above, the cutting element assembly 300 may be inserted into a cutting element pocket of the blade.

Figure 4:
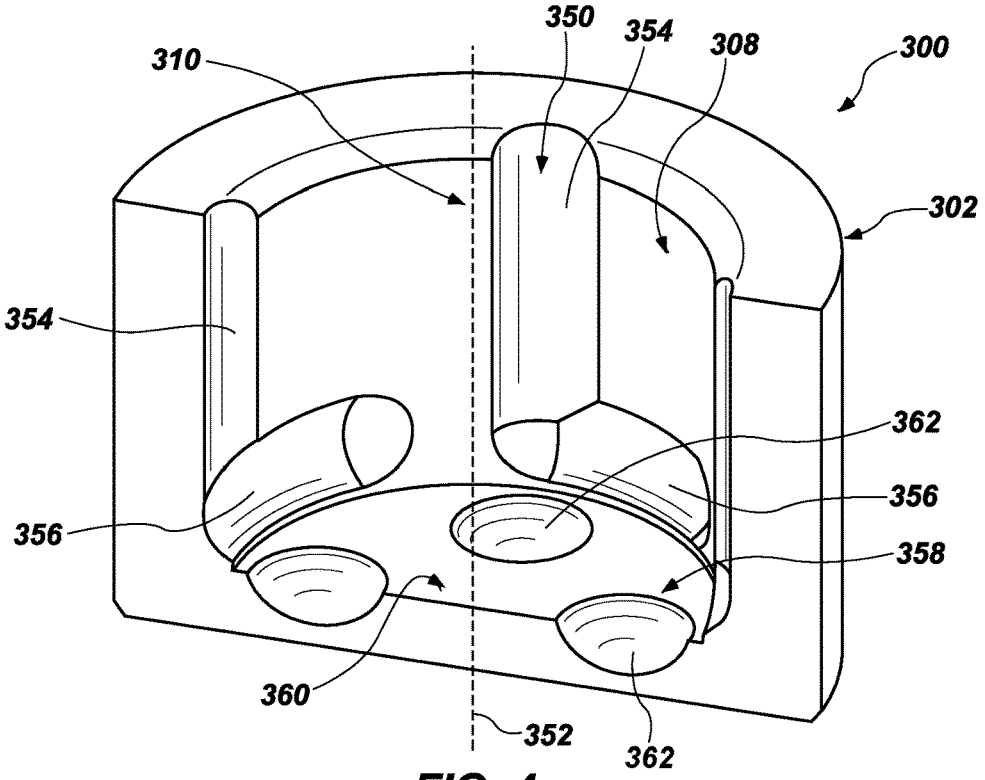
FIG. 4 is a perspective cross-sectional view of a sleeve of a cutting element assembly according to one or more embodiments of the present disclosure.

FIG. 4 is a perspective cross-sectional view of a sleeve 302 of a cutting element assembly 300. Referring to FIGS. 3 and 4 together, the cutting element 304 may be at least partially disposed within the sleeve 302. As discussed above, the sleeve 302 may be secured to the blade. For example, the sleeve 302 may be brazed or welded within a pocket of the blade. In other embodiments, the sleeve 302 may be integrally formed with the blade, such that there is no physical interface between the sleeve 302 and the blade. In other words, the blade may be formed to include the features of the sleeve 302. Further, the sleeve 302 may comprise a preformed component that is secured to the blade during formation of the blade and body from which the blade may protrude, by insertion of the sleeve 302 into a mold cavity wherein the body and blade are formed as by infiltration of matrix material, or by casting.

The rotatable cutting element 304 may include a polycrystalline hard material 318 bonded to a substrate 320 at an interface 322. In other embodiments, the rotatable cutting element 304 may be formed entirely of the polycrystalline hard material 318, or may have another material in addition to the polycrystalline hard material 318 and the substrate 320. The polycrystalline hard material 318 may include diamond, cubic boron nitride, or another hard material, for example. The substrate 320 may include, for example, cobalt-cemented tungsten carbide or another carbide material.

The polycrystalline hard material 318 may have an end cutting surface 324, and may also have other surfaces, such as a side surface 326, a chamfer, etc., which surfaces may be cutting surfaces intended to contact a subterranean formation. The polycrystalline hard material 318 may be generally cylindrical, and the interface 322 may be generally parallel to the end cutting surface 324.

The substrate 320 may have a first generally cylindrical portion 328 and a second generally cylindrical portion 330. The first generally cylindrical portion 328 may share a center longitudinal axis 331 with the second generally cylindrical portion 330. In some embodiments, the second generally cylindrical portion 330 may have a smaller outer diameter than the first generally cylindrical portion 328. Additionally, in one or more embodiments, the first generally cylindrical portion 328 may have an outer diameter that is at least substantially the same as an outer diameter of the sleeve 302. The substrate 320 may have a back surface 334 at least substantially parallel to the end cutting surface 324 of the polycrystalline hard material 318 and/or to the interface 322 between the polycrystalline hard material 318 and the substrate 320. Although the substrate 320 of the cutting element 304 described herein has a planar cutting face of polycrystalline hard material 318 located thereon, the disclosure is not so limited. Rather, the cutting element 304 may include shaped cutting elements having dome shapes, conical shapes, pyramid shapes, or any other suitable shape of cutting face. As a non-limiting example, the cutting element 304 may include any of the cutting elements described in U.S. Pat. No. 8,794,356, to Lyons et al., issued Aug. 5, 2014, the disclosure of which is incorporated in its entirety by reference herein.

The cutting element 304 may further include a first plurality of retention elements 336 and a plurality of slots 338. The first plurality of retention elements 336 may extend substantially radially from an outer surface of the second generally cylindrical portion 330 proximate a bottom (e.g., the back surface 334) of the substrate. In some embodiments, each retention element 336 of the first plurality of retention elements 336 may include a semispherical protrusion (e.g., bump or dome) extending from the outer surface of the second generally cylindrical portion 330. In some instances, the first plurality of retention elements 336 may be spaced angularly around a circumference of the second generally cylindrical portion 330 of the cutting element 304. For example, the retention elements 336 of the first plurality of retention elements 336 may be spaced apart angularly by about 90°. In other embodiments, the retention elements 336 of the first plurality of retention elements 336 may be spaced apart angularly by about 30°, 45°, 60°, or 120°.

The plurality of slots 338 may be formed in the second generally cylindrical portion 330 and may extend axially (e.g., in a direction parallel to a longitudinal axis of the cutting element 304) from the back surface 334 of the cutting element 304 and partially along the second generally cylindrical portion 330. In some embodiments, each slot 338 of the plurality of slots 338 may be formed between adjacent retention elements 336 of the first plurality of retention elements 336.

The cutting element assembly 300 may further include a rotation restriction element 340. The rotation restriction element 340 may be at least partially disposed within an interior of the second generally cylindrical portion 330 of the cutting element 304. The rotation restriction element 340 may include a center portion 342, a plurality of teeth 344, and a second plurality of retention elements 346. The plurality of teeth 344 may extend substantially radially outward from the center portion 342 of the rotation restriction element 340, and each tooth 344 of the plurality of teeth 344 may extend at least partially through a respective slot 338 of the plurality of slots 338. Additionally, in some embodiments, each tooth 344 of the plurality of teeth 344 may have a thickness along an axial direction of the cutting element 304 that is less the depth of the plurality of slots 338 such that the plurality of teeth 344 can slide up and down within the plurality of slots 338 without sliding beyond the back surface 334 of the cutting element 304. As used herein the term "axial direction" may refer to a direction along the center longitudinal axis 331 of the cutting element 304. As is discussed in greater detail below, when the cutting element 304 is rotated, mechanical interference between the plurality of teeth 344 of the rotation restriction element 340 and the cutting element 304 (via the plurality of slots 338) may cause the rotation restriction element 340 to rotate with the cutting element 304.

The second plurality of retention elements 346 may extend axially from a bottom surface 348 (e.g., back surface) of the rotation restriction element 340. In some embodiments, each retention element 346 of the second plurality of retention elements 346 may extend at least partially from a respective tooth 344 of the plurality of teeth 344. Furthermore, each retention element 346 of the second plurality of retention elements 346 may include a semispherical protrusion (e.g., dome or bump) extending from the bottom surface 348 of the rotation restriction element 340. As is discussed below, the rotation restriction element 340 may restrict rotation of the cutting element 304 within the sleeve 302.

The sleeve 302 may include a first generally cylindrical interior surface 308 defining a cutter-receiving aperture 310 extending partially through the sleeve 302 and a base portion 358 at an end of the cutter-receiving aperture 310. Additionally, the cutter-receiving aperture 310 may be sized and shaped to receive at least a portion of the rotatable cutting element 304.

The sleeve 302 may further include a first plurality of recesses 350 formed in first generally cylindrical interior surface 308. For example, the first plurality of recesses 350 may extend substantially radially outward from a center longitudinal axis 352 of the sleeve 302 and into the sleeve 302 (e.g., from the first generally cylindrical interior surface 308 of the sleeve 302). Each recess 350 of the first plurality of recesses 350 may have a first portion 354 and a second portion 356. Each first portion 354 of each recess 350 may extend axially (e.g., along a direction parallel to the center longitudinal axis 352 of the sleeve) from a top of the sleeve 302 to a portion of the sleeve proximate the base portion 358, and each second portion 356 of each recess 350 may extend angularly from a bottom of the first portion 354 (e.g., in a direction orthogonal to the center longitudinal axis 352 of the sleeve 302) and along the first generally cylindrical interior surface 308 of the sleeve 302. In some instances, the second portion 356 may extend around the sleeve 302 for about 45°. In other embodiments, the second portion 356 may extend around the sleeve 302 for about 30°, 60°, or 90°. For example, the first and second portions 354, 356 of each recess 350 of the first plurality of recesses 350 may form an "L" shape.

The first plurality of recesses 350 of the sleeve 302 may correlate to the first plurality of retention elements 336 of the cutting element 304. For example, the first plurality of recesses 350 may be sized and shaped to receive and engage the first plurality of retention elements 336 of the cutting element 304. Furthermore, as is discussed in greater detail below, the first plurality of recesses 350 may enable the cutting element 304 to be inserted into the sleeve 302 by sliding the first plurality of retention elements 336 within the first portions 354 of the first plurality of recesses 350, rotating the cutting element 304 within the sleeve 302 along the second portions 356 of the first plurality of recesses 350, and retaining the cutting element 304 within the sleeve 302 via mechanical interference between the first plurality of recesses 350 and the first plurality of retention elements 336. In some embodiments, the first plurality of recesses 350 may have a semi-cylindrical shape so as to receive the semi-spherical (i.e., domed) shapes of the first plurality of retention elements 336.

As noted above, the cutter-receiving aperture 310 may extend only partially through the sleeve 302 (i.e., the cutter-receiving aperture 310 may define a pocket), and the sleeve 302 may include the base portion 358 (e.g., a bottom of the pocket). The base portion 358 having an at least substantially planar top surface 360 and a second plurality of recesses 362 extending in an axial direction into the base portion 358 from the planar top surface 360 of the base portion 358. The second plurality of recesses 362 of the sleeve 302 may correlate to the second plurality of retention elements 346 of the rotation restriction element 340. For example, the second plurality of recesses 362 of the sleeve 302 may be sized and shaped to receive the second plurality of retention elements 346 of the rotation restriction element 340. For example, each recess 362 of the second plurality of recesses 362 may include an inverted dome shape having a radius of curvature. As is discussed in greater detail below, the second plurality of recesses 362 of the sleeve 302 may at least partially prevent rotation of the cutting element 304 within the sleeve 302 via mechanical interference with the second plurality of retention elements 346 of the rotation restriction element 340.

Figure 5A:
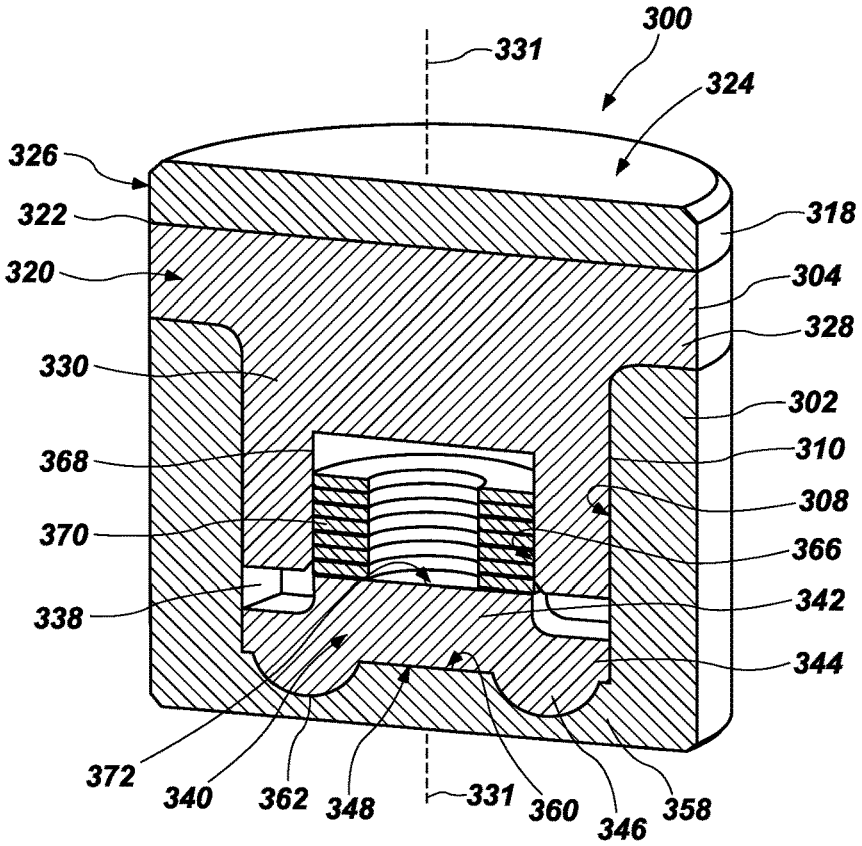
FIGS. 5A-5C show various views of a cutting element assembly according to one or more embodiments of the present disclosure.
Figure 6:
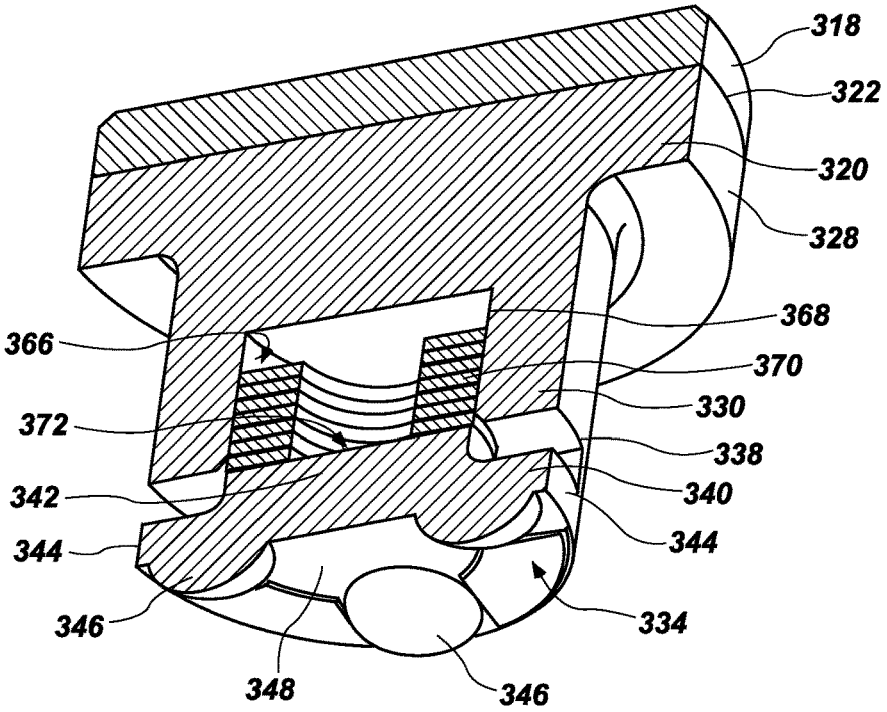
FIG. 6 is a perspective cross-sectional view of a cutting element according to one or more embodiments of the present disclosure.
Figure 5B:
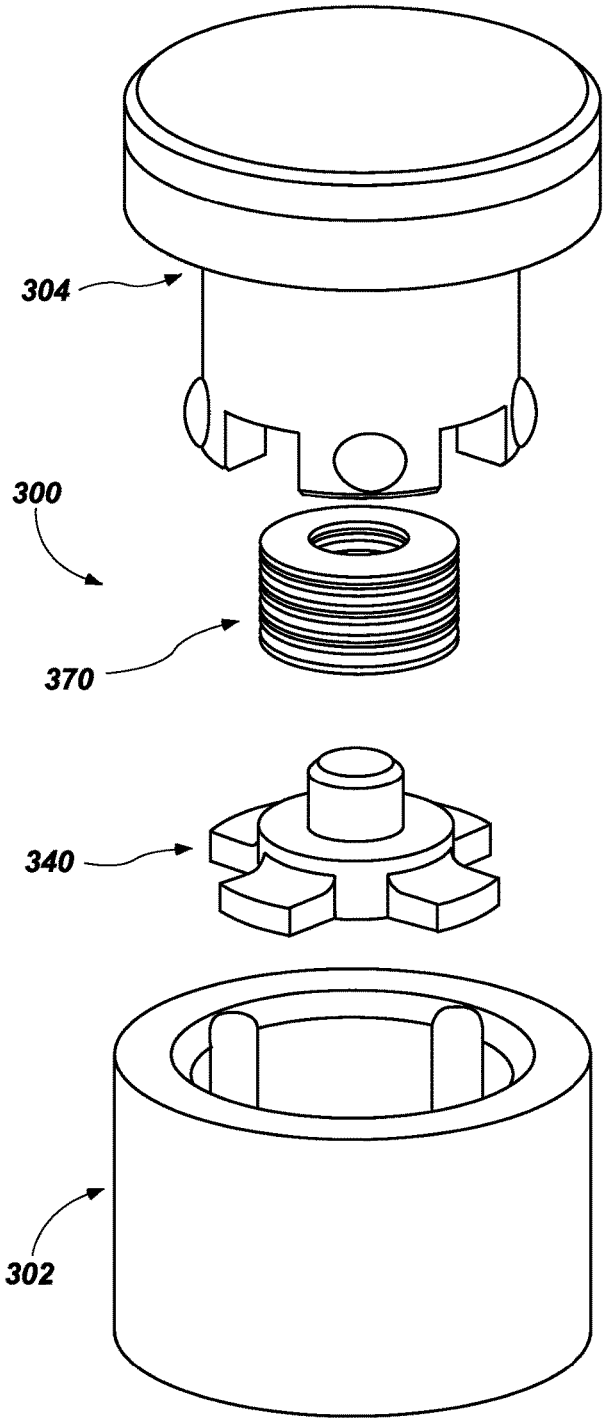
Figure 5C:
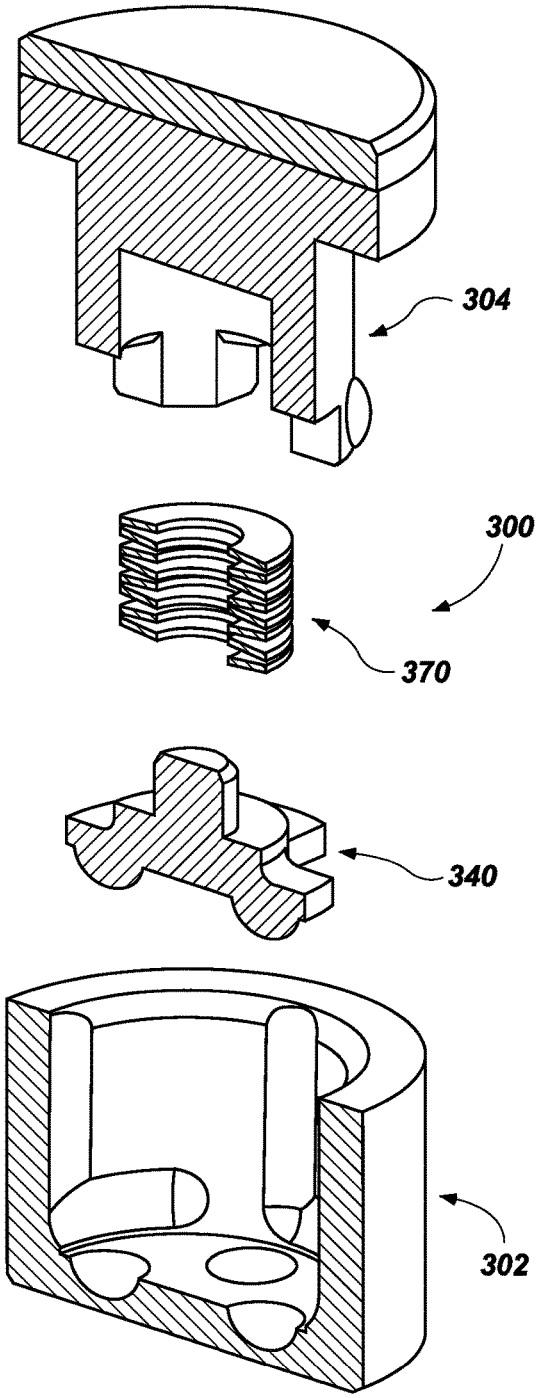

FIG. 5A is perspective cross-sectional view of the cutting element assembly 300 having the cutting element 304 disposed within the sleeve 302. FIG. 5B is an exploded view of the cutting element assembly 300 of FIG. 5A. FIG. 5C is a cross-sectional exploded view of the cutting element assembly 300 of FIG. 5A. FIG. 6 is a bottom perspective cross-sectional view of the cutting element 304 of the cutting element assembly 300. Referring to FIGS. 5 and 6 together, the cutting element 304 may also include a second generally cylindrical interior surface 366 defining a rotation-restriction-element-receiving aperture 368 (hereinafter "restriction-element-receiving aperture 368") extending at least partially through the substrate 320 of the cutting element 304 and for receiving at least a portion of the rotation restriction element 340. In some embodiments, the restriction-element-receiving aperture 368 may extend from the back surface 334 of the substrate 320 and partially through the substrate 320 of the cutting element 304. In particular, the restriction-element-receiving aperture 368 may define a pocket (e.g., cavity) in the substrate 320 of the cutting element 304.

As shown, the cutting element assembly 300 may further include a biasing member 370 (e.g., a spring) extending from a top surface 372 of the center portion 342 of the rotation restriction element 340 and in a direction normal to the bottom surface 348 of the rotation restriction element 340. For example, the rotation restriction element 340 may be spring loaded. Additionally, when the cutting element assembly 300 is assembled, the biasing member 370 may be disposed within the restriction-element-receiving aperture 368 and may apply a force to the top surface 372 of the center portion 342 of the rotation restriction element 340 when compressed. For instance, the biasing member 370 may press the rotation restriction element 340 against the base portion of 358 the sleeve 302. As is discussed in greater detail below, the biasing member 370 may cause the second plurality of retention elements 346 of the rotation restriction element 340 to be retained (absent a sufficient applied torque) within the second plurality of recesses 362 of the base portion 358 of the sleeve 302.

In one or more embodiments, the biasing member 370 may include a plurality of biasing members stacked in series with and/or parallel to each other. For example, the biasing member 370 may include a plurality of discs and/or washers (e.g., Belleville) springs in series with and/or parallel (e.g., a nested Belleville stack) to each other. As will be understood by one of ordinary skill in the art, the Belleville springs may be oriented relative to each other in series or parallel to achieve desired peak loads and desired displacement amplitudes. In some embodiments, the biasing member 370 may have a stiffness value within a range of about 65 lb/in peak load to about 100 lb/in peak load. For example, the biasing member 370 may have a stiffness value of about 70 lb/in peak load.

Referring to FIGS. 3-6 together, the cutting element assembly 300 may enable a cutting element 304 to be retained within the sleeve 302 and to be removable from the sleeve 302 without any heat application. For example, in operation, the cutting element 304 may be inserted into the sleeve 302 by aligning the first plurality of retention elements 336 with the first portions 354 of the first plurality of recesses 350 and sliding the first plurality of retention elements 336 along and within the first portions 354 of the first plurality of recesses 350 in an axially direction and into the cutter-receiving aperture 310. The cutting element 304 may be pressed into the cutter-receiving aperture 310 until the second plurality of retention elements 346 of the rotation restriction element 340 press against the top surface 360 of the base portion 358 of the sleeve 302. The cutting element 304 and the rotation restriction element 340 may be pressed against the base portion 358 of the sleeve 302 causing the biasing member 370 to compress until the first plurality of retention elements 336 are aligned with the second portions 356 of the first plurality of recesses 350.

Once the first plurality of retention elements 336 are aligned with the second portions 356 of the first plurality of recesses 350, the cutting element 304 may be rotated in a direction in which the second portions 356 of the first plurality of recesses 350 extend. The cutting element 304 may be rotated until the second plurality of retention elements 346 engage (e.g., drop into) the second plurality of recesses 362 and are pressed into the second plurality of recesses 362 by the biasing member 370. In some embodiments, the cutting element 304 may be rotated about 45°. In other embodiments, the cutting element 304 may be rotated between about 30° and about 90°.

When the cutting element 304 is inserted into the sleeve 302 in the foregoing described manner, the first plurality of retention elements 336 may retain the cutting element 304 within the sleeve 302 via mechanical interference with the first plurality of recesses 350. Furthermore, the second plurality of retention elements 346 may prevent the cutting element 304 from rotating within the sleeve 302 unless the cutting element 304 is subjected to at least a selected amount of torque. For instance, the amount of torque must overcome a force of the biasing member 370 pressing the second plurality of retention elements 346 into the second plurality of recesses 362. For example, the second plurality of retention elements 346 may prevent the cutting element 304 from rotating within the sleeve 302 unless the cutting element 304 is subjected to a torque value of at least about 10 lbf·ft. In other embodiments, the second plurality of retention elements 346 may prevent the cutting element 304 from rotating within the sleeve 302 unless the cutting element 304 is subjected to a torque value within a range of about 10 lbf·ft to about 40 lbf·ft. In further embodiments, the second plurality of retention elements 346 may prevent the cutting element 304 from rotating within the sleeve 302 unless the cutting element 304 is subjected to a torque value within a range of about 40 lbf·ft to about 70 lbf·ft. In yet further embodiments, the second plurality of retention elements 346 may prevent the cutting element 304 from rotating within the sleeve 302 unless the cutting element 304 is subjected to a torque value within a range of about 70 lbf·ft to about 100 lbf·ft. As a result, the cutting element 304 may be removed by applying a sufficient torque to the cutting element 304. Furthermore, as will be understood by one of ordinary skill in the art, due to the foregoing, the cutting element 304 may not passively rotate within the sleeve 302 when subjected to typical external forces during a drilling operation (e.g., as a result of contacting a formation).

In one or more embodiments, the cutting element 304 may include one or more features that enable the cutting element 304 to be gripped (e.g., grasped) by a tool (e.g., a wrench) to apply torque to the cutting element 304. For example, the cutting element 304 may include one or more of a flat surface, a groove, a recess, textured surface, etc.

Applying a sufficient torque to the cutting element 304 may cause the second plurality of retention elements 346 to slide along curved surfaces of the second plurality of recesses 362. Furthermore, an amount of torque required to cause the second plurality of retention elements 346 to slide along the curved surfaces of the second plurality of recesses 362 and compress the biasing member 370 may be a function of the curvature of each recess 362 of the second plurality of recesses 362. For example, a recess 362 having a larger radius of curvature (e.g., a shallow curvature) may require less torque to slide a respective retention element 346 out of the recess 362 in comparison to a recess 362 having a smaller radius of curvature (e.g., a steep curvature). Accordingly, a required torque to rotate the cutting element 304 within the sleeve 302 may be selectable based on the radii of curvatures of the second plurality of recesses 362 and the stiffness of the biasing member 370.

As the second plurality of retention elements 346 slide along the curved surfaces of the second plurality of recesses 362, the biasing member 370 may be compressed and the plurality of teeth 344 may be pushed further into the plurality of slots 338 until the second plurality of retention elements 346 are free (e.g., out) of the second plurality of recesses 362. The cutting element 304 may be rotated within the sleeve 302 and the first plurality of retention elements 336 may slide within the second portions 356 of the first plurality of recesses 350 until the first plurality of retention elements 336 are aligned with the first portions 354 of the first plurality of recesses 350. Afterward, the cutting element 304 may be pulled out of the sleeve 302 while the first plurality of retention elements 336 slide within the first portions 354 of the first plurality of recesses 350.

Referring again to FIGS. 3-6, in some embodiments, the second plurality of retention elements 346 of the rotation restriction element 340 of the cutting element assembly 300 may have shapes varying from semispherical protrusions. For example, the second plurality of retention elements 346 may have cylindrical shapes, cuboids, or any other shapes. As a result, the rotation restriction element 340 and the cutting element 304 may not be rotatable by merely applying torque to the cutting element 304. Accordingly, in such embodiments, the sleeve 302 may further include an access aperture extending through the base portion 358 of the sleeve 302, and an associated drill bit may include a corresponding access aperture such that a back of the rotation restriction element 340 may be accessible via the access apertures (e.g., with a rod). In operation, a rod may be inserted into the access aperture and pressed against the rotation restriction element causing the biasing member 370 to compress, disengaging the second plurality of retention elements 346 from the second plurality of recesses 362, and allowing the cutting element 304 to be rotated. As a result, the access aperture may enable the rotation restriction element 340 to utilize a second plurality of retention elements having shapes other than semispherical protrusions.

The rotatable and removable cutting elements assemblies 300 as disclosed herein may have certain advantages over conventional fixed cutting elements. For example, sleeves 302 may be installed into a bit body (e.g., by brazing) before the cutting elements are installed into the sleeves. Thus, the cutting elements 304, and particularly the PDC tables, need not be exposed to the high temperatures typical of brazing. Thus, installing rotatable and removable cutting elements 304 into sleeves 302 already secured to a bit body may avoid thermal damage caused by brazing. Furthermore, cutting elements 304 as disclosed herein may be relatively easily removed and replaced, such as when the cutting elements are worn or damaged. For instance, removal of a cutting element 304 from a sleeve 302 secured by the first and second pluralities of retention elements 336, 346 disclosed may be trivial in comparison to removal of cutting elements brazed into a bit body. For example, as discussed above, the cutting elements 304 depicted in FIGS. 3-6 may be removed by applying a toque to the cutting element 304 and causing the cutting element 304 to rotate within the sleeve 302 until the first plurality of retention elements 336 are aligned with the first portions 354 of the first plurality of recesses 350. Afterward, the cutting element 304 may be easily pulled out of the sleeve 302. Similarly, insertion of a new cutting element or the same cutting element 304 (e.g., a repaired cutting element or a cutting element rotated to expose a different cutting edge) may be effected rapidly and without heating the drill bit. In view of the foregoing, the cutting element 304 may be rotated, fully removed, and/or replaced without heat. Thus, drill bits may be more quickly repaired than drill bits having conventional cutting elements.

Figure 7A:
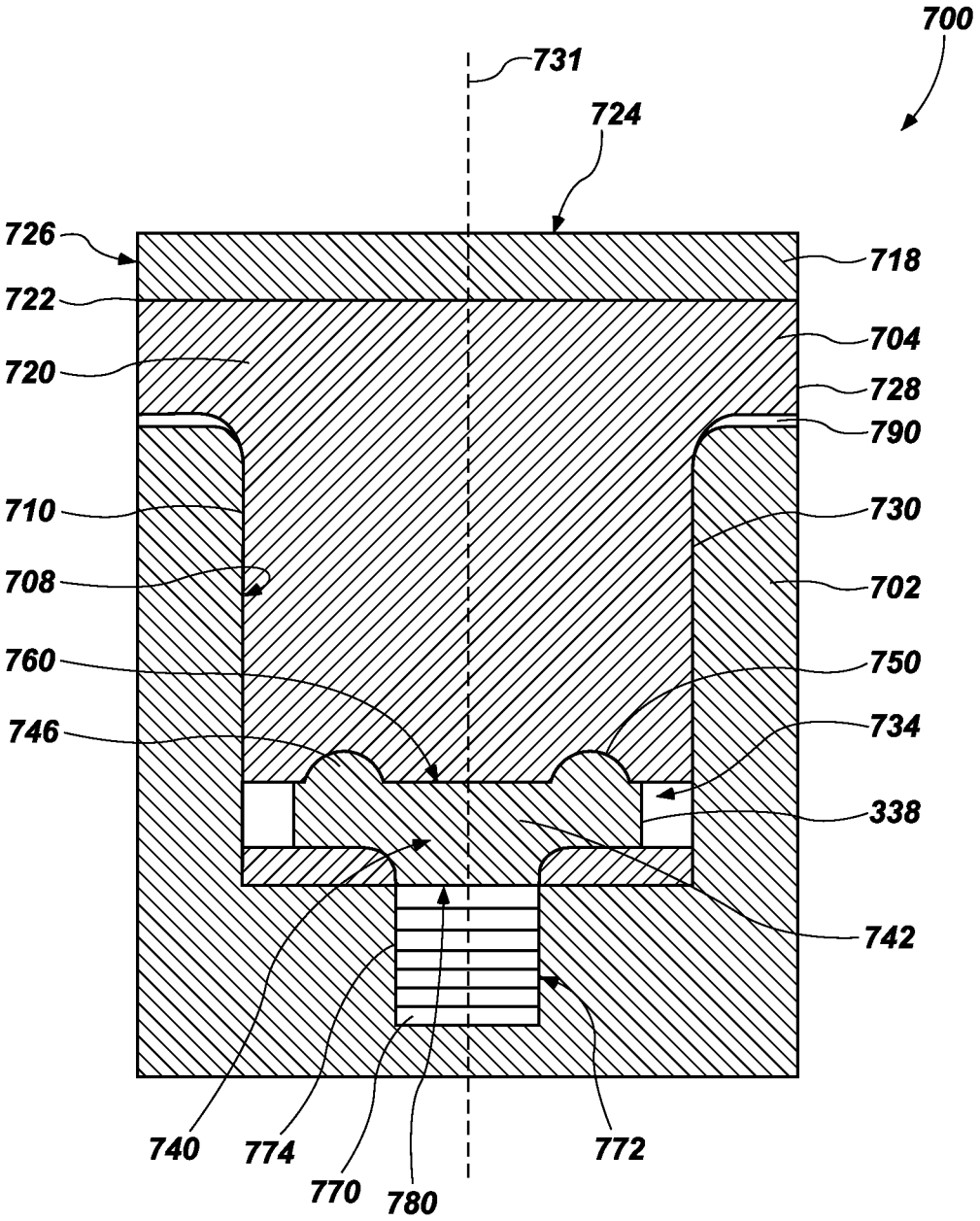
FIG. 7A is a cross-sectional view a cutting element assembly according to additional embodiments of the present disclosure.
Figure 7B:
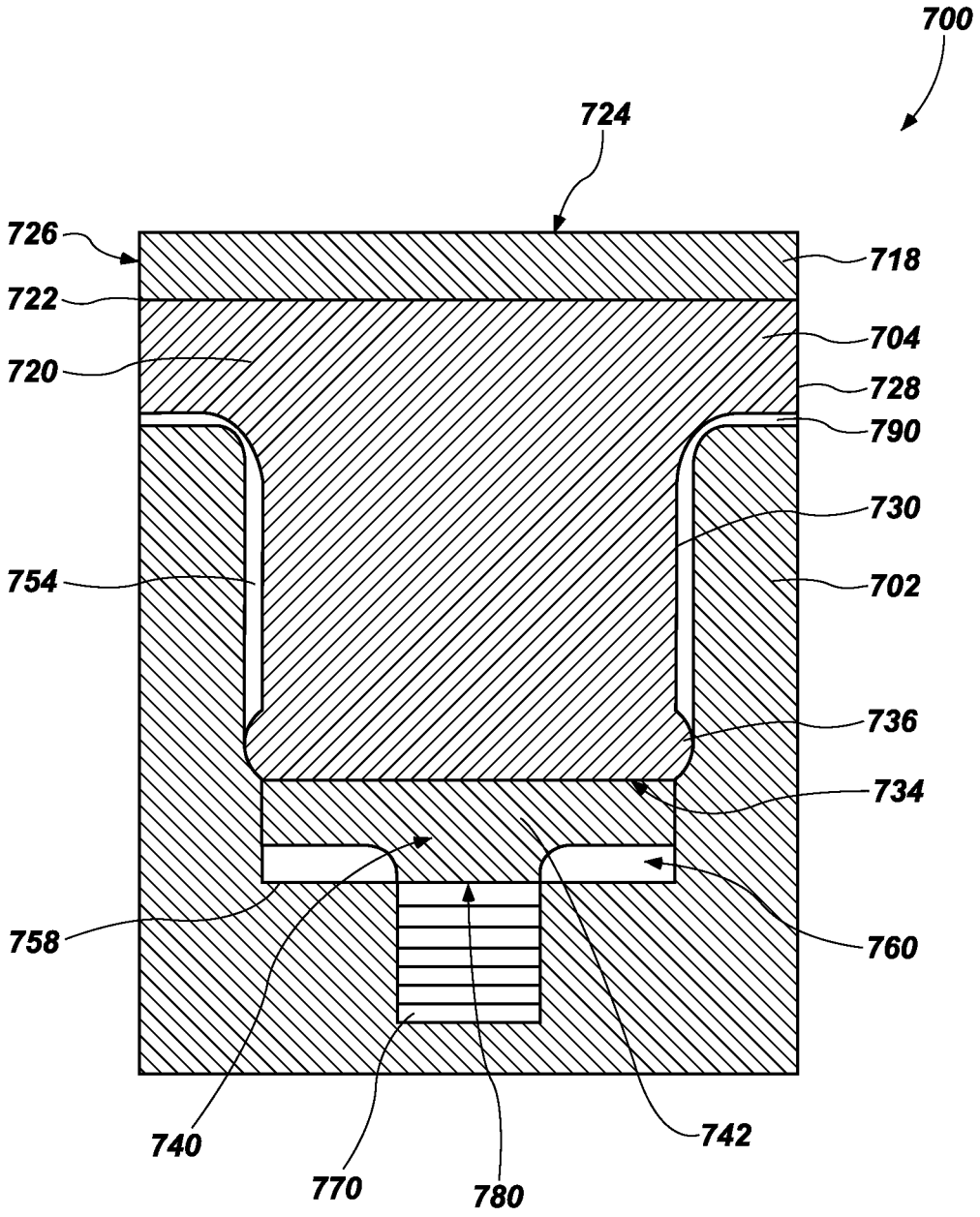
FIG. 7B is another cross-sectional view of the cutting element of FIG. 7A.

FIG. 7A is a cross-sectional view of a cutting element assembly 700 that can be mounted in a blade of an earth-boring tool according to additional embodiments of the present disclosure. FIG. 7B is cross-sectional view of the cutting element assembly 700 perpendicular to the view of FIG. 7A. Referring to FIGS. 7A and 7B, the cutting element assembly 700 may include a sleeve 702 and a cutting element 704. The sleeve 702 may be secured to the blade. For example, the sleeve 702 may be brazed or welded within a pocket of the blade. In other embodiments, the sleeve 702 may be integrally formed with the blade, such that there is no physical interface between the sleeve 702 and the blade.

The cutting element 704 may include a polycrystalline hard material 718 bonded to a substrate 720 at an interface 722. In other embodiments, the cutting element 704 may be formed entirely of the polycrystalline hard material 718, or may have another material in addition to the polycrystalline hard material 718 and the substrate 720. The polycrystalline hard material 718 may include diamond, cubic boron nitride, or another hard material, for example. The substrate 720 may include, for example, cobalt-cemented tungsten carbide or another carbide material.

The polycrystalline hard material 718 may have an end cutting surface 724, and may also have other surfaces, such as a side surface 726, a chamfer, etc., which surfaces may be cutting surfaces intended to contact a subterranean formation. The polycrystalline hard material 718 may be generally cylindrical, and the interface 722 may be generally parallel to the end cutting surface 724.

The substrate 720 may have a first generally cylindrical portion 728 and a second generally cylindrical portion 730. In some embodiments, the second generally cylindrical portion 730 may have a smaller outer diameter than the first generally cylindrical portion 728. Additionally, in one or more embodiments, the first generally cylindrical portion 728 may have an outer diameter that is at least substantially the same as an outer diameter of the sleeve 702. The substrate 720 may have a back surface 734 at least substantially parallel to the end cutting surface 724 of the polycrystalline hard material 718 and/or to the interface 722 between the polycrystalline hard material 718 and the substrate 720.

Similar to the cutting element 304 of FIGS. 3-6, the cutting element 704 may include a first plurality of retention elements 736 and a first plurality of recesses 750. The first plurality of retention elements 736 may extend substantially radially from an outer surface of the second generally cylindrical portion 730 proximate a bottom (e.g., the back surface 734) of the substrate. In some embodiments, each retention element 736 of the first plurality of retention elements 736 may include a semispherical protrusion (e.g., bump or dome) extending from the outer surface of the second generally cylindrical portion 730. In some instances, the first plurality of retention elements 736 may be spaced angularly around a circumference of the second generally cylindrical portion 730 of the cutting element 704. For example, the first plurality of retention elements 736 may be spaced according to any of the manners described above in regard to FIGS. 3-6.

The cutting element assembly 700 may further include a rotation restriction element 740 and a biasing member 770. The rotation restriction element 740 may include a center portion 742 and a second plurality of retention elements 746. Unlike the embodiments of FIGS. 3-6, the rotation restriction element 740 may be fixed relative to the cutting element 704. In some embodiments, the center portion 742 may include a disc, and the second plurality of retention elements 746 may extend axially from a planar top surface 760 of the center portion 742 (e.g., a top surface of the disc) of the rotation restriction element 740. Furthermore, each retention element 746 of the second plurality of retention elements 746 may include a semispherical protrusion (e.g., dome or bump) extending from the planar top surface 760 of the center portion 742. As is discussed below, the rotation restriction element 740 may restrict rotation of the cutting element 704 within the sleeve 702, and the biasing member 770 may be at least partially disposed within the sleeve 702 of the cutting element assembly 700.

The first plurality of recesses 750 may be formed in the back surface 734 of the cutting element 704. For example, the first plurality of recesses 750 may extend axially inward from the back surface 734 of the cutting element 704. The first plurality of recesses 750 may correlate to the second plurality of retention elements 746. For example, the first plurality of recesses 750 may be sized and shaped to receive and engage the second plurality of retention elements 746. For example, each recess 750 of the first plurality of recesses 750 may include an inverted dome shape having a radius of curvature. As is discussed in greater detail below, the first plurality of recesses 750 may at least partially prevent rotation of the cutting element 704 within the sleeve via mechanical interference with the second plurality of retention elements 746 of the rotation restriction element 740.

The sleeve 702 may include a first generally cylindrical interior surface 708 defining a cutter-receiving aperture 710 extending partially through the sleeve 702 and a second generally cylindrical interior surface 772 defining a restriction-element receiving aperture 774 extending from the first generally cylindrical interior surface 708 and further into the sleeve 702. The first and second generally cylindrical interior surfaces 708, 772 may share a center longitudinal axis 731. The cutter-receiving aperture 710 may be sized and shaped to receive at least a portion of the cutting element 704. The restriction-element receiving aperture 774 may be sized and shaped to receive at least a portion of the rotation restriction element 740 of the cutting element 704.

The sleeve 702 may further include a second plurality of recesses 754 formed in first generally cylindrical interior surface 708 of the sleeve 702. Furthermore, the second plurality of recesses 754 may include any of the first plurality of recesses 350 described in regard to FIGS. 3-6.

The cutter-receiving aperture 710 may extend only partially through the sleeve 702 (i.e., the cutter-receiving aperture 710 may define a pocket), and the sleeve 702 may include a base portion 758 (e.g., a bottom of the pocket) of the sleeve 702 having an at least substantially planar top surface 760, and the restriction-element receiving aperture 774 may extend into the base portion 758 of the sleeve 702.

The biasing member 770 may be disposed within the restriction-element-receiving aperture 774 and may apply a force to a bottom surface 780 of the center portion 742 of the rotation restriction element 740 when compressed. For instance, the biasing member 770 may press the rotation restriction element 740 against the back surface 734 of the cutting element 704. As is discussed in greater detail below, the biasing member 770 may cause the second plurality of retention elements 746 to be retained (absent a sufficient applied torque) within the first plurality of recesses 750 of the cutting element 704. The biasing member 770 may include any of the biasing members describe above in regard to FIGS. 3-6.

Referring still to FIGS. 7A and 7B, in some embodiments, the cutting element assembly 700 may further include an impact absorber 790 between the cutting element 304 and the sleeve 702. For example, the cutting element assembly 700 may include a relatively soft material between the cutting element 704 and the sleeve 702. For instance, the impact absorber 790 may include a washer of relatively soft material such as, for example, copper or other similar materials, disposed between a top of the sleeve 702 and the first generally cylindrical portion 728 of the cutting element 704.

Additional non limiting example embodiments of the disclosure are described below.

Embodiment 1

A cutting element assembly for a downhole tool, comprising: a sleeve having a cutter-receiving aperture extending through the sleeve; a cutting element comprising a first plurality of retention elements extending substantially radially from an outer surface of the cutting element and engaging the sleeve to retain the cutting element within the sleeve; and a rotation restriction element coupled to the cutting element and including a second plurality of retention elements extending axially from a bottom surface of the rotation restriction element and engaging the sleeve to restrict rotation of the cutting element within the sleeve.

Embodiment 2

The cutting element assembly of Embodiment 1, wherein the cutting element comprises: a first cylindrical portion; and a second cylindrical portion having a smaller diameter than the first cylindrical portion and extending from the first cylindrical portion, the second cylindrical portion sharing a center axis with the first cylindrical portion, wherein the first plurality of retention elements extend from the second cylindrical portion.

Embodiment 3

The cutting element assembly of Embodiment 2, wherein the cutting element further comprises a plurality of slots formed in the second cylindrical portion of the cutting element and extending axially from a back surface of the cutting element, each slot of the plurality of slots being formed between adjacent retention elements of the first plurality of retention elements.

Embodiment 4

The cutting element assembly of either of Embodiments 2 or 3, wherein the rotation restriction element comprises: a center portion; and a plurality of teeth extending out substantially radially from the center portion, wherein each retention element extends axially from a respective tooth of the plurality of teeth of the rotation restriction element.

Embodiment 5

The cutting element assembly of Embodiment 4, wherein each tooth of the plurality of teeth extends through a respective slot of the plurality of slots of the cutting element.

Embodiment 6

The cutting element assembly of any one of Embodiments 2 through 5, wherein the second cylindrical portion of the cutting element comprises a restriction-element-receiving aperture extending partially therethrough from the back surface of the cutting element such that the center portion of the rotation restriction element is disposed within an interior of the second cylindrical portion of the cutting element.

Embodiment 7

The cutting element assembly of either of Embodiments 1 through 6, wherein the cutting element assembly further comprises a biasing member disposed within a restriction-element-receiving aperture of the cutting element, wherein the biasing member is located and oriented to press the second plurality of retention elements against the sleeve.

Embodiment 8

The cutting element assembly of Embodiment 7, wherein the biasing member comprises at least one Belleville spring.

Embodiment 9

The cutting element assembly of any one of Embodiments 1 through 8, wherein the first plurality of retention elements comprises a plurality of semispherical protrusions.

Embodiment 10

The cutting element assembly of any one of Embodiments 1 through 9, wherein the sleeve comprises a first plurality of recesses extending along a first generally cylindrical interior surface of the cutter-receiving aperture of the sleeve and correlating to the first plurality of retention elements of the cutting element.

Embodiment 11

The cutting element assembly of Embodiment 10, wherein each recess of the first plurality of recesses comprises: a first portion extending axially from a top of the sleeve; and a second portion extending from a bottom of the first portion and extending in a direction orthogonal to a longitudinal axis of the sleeve.

Embodiment 12

The cutting element assembly of either of Embodiments 10 or 11, wherein the sleeve comprises a second plurality of recesses formed within a base portion of the sleeve and sized and shaped to receive the second plurality of recesses of the rotation restriction element.

Embodiment 13

A downhole tool, comprising: a bit body including at least one blade extending therefrom; and the cutting element assembly of any one of Embodiments 1-12 disposed on the at least one blade.

Embodiment 14

The downhole tool of Embodiment 13, wherein the at least one sleeve of the cutting element assembly is brazed to the bit body within a pocket of the at least one blade.

Embodiment 15

A downhole tool, comprising: a body; at least one sleeve secured to the body and defining a cutter-receiving aperture; at least one cutting element disposed within the cutter-receiving aperture of the at least one sleeve, the at least one cutting element comprising: a first cylindrical portion; a second cylindrical portion having a smaller diameter than the first cylindrical portion and extending from the first cylindrical portion, the second cylindrical portion sharing a center axis with the first cylindrical portion; and a first plurality of retention elements extending substantially radially from an outer surface of the second cylindrical portion of the at least one cutting element and engaging the at least one sleeve to retain the at least one cutting element within the at least one sleeve; and a rotation restriction element coupled to the at least one cutting element and including a second plurality of retention elements extending axially from a bottom surface of the rotation restriction element and engaging the at least one sleeve to restrict rotation of the at least one cutting element within the at least one sleeve.

Embodiment 16

The downhole tool of Embodiment 15, wherein the rotation restriction element comprises: a center portion; and a plurality of teeth extending out substantially radially from the center portion, wherein each retention element extends axially from a respective tooth of the plurality of teeth of the rotation restriction element.

Embodiment 17

The downhole tool of either of Embodiments 15 or 16, wherein the downhole tool further comprises a biasing member disposed within a restriction-element-receiving aperture of the at least one cutting element, wherein the biasing member is located and oriented to press the second plurality of retention elements against the at least one sleeve.

Embodiment 18

The downhole tool of Embodiment 17, wherein the biasing member comprises at least one Belleville spring.

Embodiment 19

The downhole tool of any one of Embodiments 15 through 18, wherein the at least one sleeve comprises a first plurality of recesses extending axially along a first generally cylindrical interior surface of the cutter-receiving aperture of the at least one sleeve and correlating to the first plurality of retention elements of the at least one cutting element.

Embodiment 20

The downhole tool of any one of Embodiments 15 through 19, wherein the at least one sleeve is brazed to the bit body within a pocket of the at least one blade.

Embodiment 21

The downhole tool of any one of Embodiments 15 through 20, wherein the at least one sleeve comprises a second plurality of recesses formed within a base portion of the at least one sleeve and sized and shaped to receive the second plurality of recesses of the rotation restriction element.

Embodiment 22

A method of forming a downhole tool, comprising: forming a bit body that includes at least one blade extending from the bit body; securing at least one sleeve to the at least one blade, the at least one sleeve defining a cutter-receiving aperture; and inserting a cutting element into the cutter-receiving aperture of the at least one sleeve and causing a first plurality of retention elements of the cutting element to slide within first portions of a first plurality of recesses of the at least one sleeve; rotating the cutting element within the at least one sleeve to cause the first plurality of retention elements of the cutting element to slide within second portions of the first plurality of recesses of the at least one sleeve; and causing a second plurality of retention elements of the cutting element to engage a second plurality of recesses of the at least one sleeve.

Embodiment 23

The method of Embodiment 22, wherein inserting a cutting element into the cutter-receiving aperture of the at least one sleeve comprises causing a biasing member within the cutting element to at least partially compress.

Embodiment 24

The method of either of Embodiments 22 or 23, wherein causing a biasing member within the cutting element to at least partially compress comprises causing the biasing member to press the second plurality of retention elements axially against the second plurality of recesses at least one sleeve.

Embodiment 25

The method of any one of Embodiments 22 through 24, wherein rotating the cutting element within the at least one sleeve comprises rotating the cutting element about 45°.

Embodiment 26

The method of any one of Embodiments 22 through 25, wherein causing a second plurality of retention elements of the cutting element to engage a second plurality of recesses of the at least one sleeve comprises engaging a rotation restriction element disposed partially within and coupled to the cutting element and including the second plurality of retention elements thereon with the second plurality of recesses of the at least one sleeve.

Embodiment 27

The method of any one of Embodiments 22 through 26, further comprising retaining the cutting element in the at least one sleeve by mechanical interference of the first plurality of retention elements with the first plurality of recesses and mechanical interference of the second plurality of retention elements with the second plurality of recesses.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A cutting element assembly for a downhole tool, comprising:

a sleeve having a cutter-receiving aperture extending through the sleeve;

a cutting element comprising a first plurality of retention elements extending substantially radially from an outer surface of the cutting element and engaging the sleeve to retain the cutting element within the sleeve; and a rotation restriction element coupled to the cutting element, the rotation restriction element comprising:

a second plurality of retention elements extending axially from a bottom surface of the rotation restriction element and engaging the sleeve to restrict rotation of the cutting element within the sleeve;

a center portion; and a plurality of teeth extending out substantially radially from the center portion, wherein each retention element extends axially from a respective tooth of the plurality of teeth of the rotation restriction element.

2. The cutting element assembly of claim 1, wherein the cutting element comprises:

a first cylindrical portion; and a second cylindrical portion having a smaller diameter than the first cylindrical portion and extending from the first cylindrical portion, the second cylindrical portion sharing a center axis with the first cylindrical portion, wherein the first plurality of retention elements extend from the second cylindrical portion.

3. The cutting element assembly of claim 2, wherein the cutting element further comprises a plurality of slots formed in the second cylindrical portion of the cutting element and extending axially from a back surface of the cutting element, each slot of the plurality of slots being formed between adjacent retention elements of the first plurality of retention elements.

4. The cutting element assembly of claim 1, wherein each tooth of the plurality of teeth extends through a respective slot of the plurality of slots of the cutting element.

5. The cutting element assembly of claim 1, wherein the cutting element assembly further comprises a biasing member disposed within a restriction-element-receiving aperture of the cutting element, wherein the biasing member is located and oriented to press the second plurality of retention elements against the sleeve.

6. The cutting element assembly of claim 1, wherein the first plurality of retention elements comprises a plurality of semispherical protrusions.

7. The cutting element assembly of claim 1, wherein the sleeve comprises a first plurality of recesses extending along a first generally cylindrical interior surface of the cutter-receiving aperture of the sleeve and correlating to the first plurality of retention elements of the cutting element.

8. The cutting element assembly of claim 7, wherein each recess of the first plurality of recesses comprises:

a first portion extending axially from a top of the sleeve; and a second portion extending from a bottom of the first portion and extending in a direction orthogonal to a longitudinal axis of the sleeve.

9. The cutting element assembly of claim 7, wherein the sleeve comprises a second plurality of recesses formed within a base portion of the sleeve and sized and shaped to receive the second plurality of recesses of the rotation restriction element.

10. A downhole tool, comprising:

a body;

at least one sleeve secured to the body and defining a cutter-receiving aperture;

at least one cutting element disposed within the cutter-receiving aperture of the at least one sleeve, the at least one cutting element comprising:

a first cylindrical portion;

a second cylindrical portion having a smaller diameter than the first cylindrical portion and extending from the first cylindrical portion, the second cylindrical portion sharing a center axis with the first cylindrical portion; and a first plurality of retention elements extending substantially radially from an outer surface of the second cylindrical portion of the at least one cutting element and engaging the at least one sleeve to retain the at least one cutting element within the at least one sleeve; and a rotation restriction element coupled to the at least one cutting element, the rotation restriction element comprising:

a second plurality of retention elements extending axially from a bottom surface of the rotation restriction element and engaging the at least one sleeve to restrict rotation of the at least one cutting element within the at least one sleeve;

a center portion; and a plurality of teeth extending out substantially radially from the center portion, wherein each retention element extends axially from a respective tooth of the plurality of teeth of the rotation restriction element.

11. The downhole tool of claim 10, wherein the downhole tool further comprises a biasing member disposed within a restriction-element-receiving aperture of the at least one cutting element, wherein the biasing member is located and oriented to press the second plurality of retention elements against the at least one sleeve.

12. The downhole tool of claim 11, wherein the biasing member comprises at least one Belleville spring.

13. The downhole tool of claim 10, wherein the at least one sleeve comprises a first plurality of recesses extending axially along a first generally cylindrical interior surface of the cutter-receiving aperture of the at least one sleeve and correlating to the first plurality of retention elements of the at least one cutting element.

14. The downhole tool of claim 10, wherein the at least one sleeve is brazed to the bit body within a pocket of the at least one blade.

15. The downhole tool of claim 10, wherein the at least one sleeve comprises a second plurality of recesses formed within a base portion of the at least one sleeve and sized and shaped to receive the second plurality of recesses of the rotation restriction element.

16. A method of forming a downhole tool, comprising:

forming a bit body that includes at least one blade extending from the bit body;

securing at least one sleeve to the at least one blade, the at least one sleeve defining a cutter-receiving aperture;

coupling a cutting element to a rotation restriction element, the rotation restriction element comprising:

a second plurality of retention elements extending axially from a bottom surface of the rotation restriction element;

a center portion; and a plurality of teeth extending out substantially radially from the center portion, wherein each retention element extends axially from a respective tooth of the plurality of teeth of the rotation restriction element;

inserting the cutting element into the cutter-receiving aperture of the at least one sleeve and causing a first plurality of retention elements of the cutting element to slide within first portions of a first plurality of recesses of the at least one sleeve;

rotating the cutting element within the at least one sleeve to cause the first plurality of retention elements of the cutting element to slide within second portions of the first plurality of recesses of the at least one sleeve; and causing the second plurality of retention elements of the cutting element to engage a second plurality of recesses of the at least one sleeve.

17. The method of claim 16, wherein inserting a cutting element into the cutter-receiving aperture of the at least one sleeve comprises causing a biasing member within the cutting element to at least partially compress.

18. The method of claim 17, wherein rotating the cutting element within the at least one sleeve comprises rotating the cutting element about 45°.

* * * * *